US005454961A

United States Patent [19]

Schriver et al.

[11] Patent Number: 5,454,961

[45] Date of Patent: Oct. 3, 1995

[54] SUBSTITUTED FULLERENES AS FLOW IMPROVERS

[75] Inventors: George W. Schriver, Somverville; Abhimanyu O. Patil, Westfield; David J. Martella, Princeton; Kenneth Lewtas, Westfield, all of N.J.

[73] Assignee: Exxon Research & Engineering Co., Florham Park, N.J.

[21] Appl. No.: 229,499

[22] Filed: Apr. 19, 1994

[51] Int. Cl.[6] ..... C10M 127/00

[52] U.S. Cl. ..... 252/9; 585/14; 252/45; 252/50; 252/52 R

[58] Field of Search ..... 252/9, 45, 50, 252/52 R; 585/14

[56] References Cited

U.S. PATENT DOCUMENTS

| | | |
|---|---|---|
| 3,961,916 | 6/1976 | Illuychyj et al. . |
| 4,211,534 | 6/1980 | Feldman . |
| 4,491,455 | 1/1985 | Ishizaki et al. . |
| 5,114,477 | 5/1992 | Mort et al. . |
| 5,177,248 | 1/1993 | Chiang et al. . |
| 5,234,474 | 8/1993 | Whewell . |
| 5,234,475 | 8/1993 | Malhotra et al. . |
| 5,258,048 | 11/1993 | Whewell . |
| 5,270,394 | 12/1993 | Hoxmeier . |
| 5,281,653 | 1/1994 | Thomann et al. . |
| 5,292,444 | 3/1994 | Patil et al. . |
| 5,292,813 | 3/1994 | Patil et al. . |

OTHER PUBLICATIONS

Wu; Tetrahedron Letters, The International Journal for the Rapid Publication of Preliminary Communications in Organic Chemistry; "Ene Reaction of Fullerene $C_{60}$ and 4–allylanisol: Introduction of Allene to Buckminister-fullerene". pp. 919–922 Feb. 18, 1994.

Kamath, et al., SAE Technical Paper Series #922284, Int'l. Fuels and Lubricants Meeting & Expo, S.F. Calif., pp. 29–35, (Oct. 19–22, 1992).

Jeon, et al., Bull, Korean Chem. Soc., vol. 12, No. 6, Communications pp. 596–598, (Dec. 20, 1991).

Olah, et al., J. Am. Chem. Soc. 113, 9387–88, (Nov. 20, 1991).

Olah, et al., J. Am. Chem. Soc., 113, pp. 9385–9387, (Nov. 20, 1991).

Diederich, et al., Acc. Chem. Res. Jan. 1992, 25, 119–126.

Samulski, et al., Chem. Mater. (Nov./Dec. 1992) 4, 1153–1157.

Miller, et al., EP. Publ. No. 0546718A2 for EP. Appl. No. 92310771.8 (16 Jun. 1993).

Miller, et al., EP. Publ. No. 0575129A1 for EP. Appl. No. 93304596.5, (22 Dec. 1993).

Isaacs, et al., Helvetica Chimica Acta, vol. 76, pp. 2454–2462. (1993) month unavailable.

Exxon Chemical, PCT/Int'l. Publ. No. WO93/08243 published 29 Apr. 1993 (Int'l Appl. No. PCT/EP92/02329).

Lewtas, EP. Publ. No. 0261957A2 for EP. Appl. No. 87308435.4 (publ. 30 Mar. 1988).

Wudl, et al., "Survey of Chem. Reactivity of $C_{60}$ . . . ", Ch. 11, pp. 161–174, Am. Chem. Soc. (1992). month unavailable.

Bausch, et al., J. Am. Chem. Soc., 113, 3205–3206 (1991). month unavailable.

Seshadri, et al., Tetrahedron Letters, 33(15), pp. 2069–2070 (1992). month unavailable.

Li, et al., J. Chem. Soc., Chem. Comm., 1784 (1993). month unavailable.

Taylor, et al., J. Chem. Soc., Chem. Comm., 667 (1992). month unavailable.

March, Advanced Organic Chemistry, 4th Ed. (1992) pp. 386–387, 900–902, 392–398. month unavailable.

Komatsu, et al., The Chem. Soc. of Japan, Chemistry Letters No. 3, pp. 635–636 (1994). month unavailable.

Suzuki, et al., Science 254, 1186–1188, (22 Nov. 1991).

*Primary Examiner*—Jacqueline V. Howard

*Attorney, Agent, or Firm*—Linda M. Scourzo

[57] ABSTRACT

The present invention relates to novel compositions that contain a base oil and certain substituted fullerenes effective to improve the cold flow properties of the base oil. Typically the substituted fullerenes have the general formula:

$$C_{Fn}(GR_y)_x$$

In the formula $C_{Fn}$ is a fullerene or mixture of fullerenes, n is the number of carbon atoms in the fullerene, x is an integer from 1 up to the maximum number of sites on the fullerene molecule available for adding substituent groups, G is a linking group that may be absent or present, and when present is an oxygen, sulfur, nitrogen, phenol, aniline, Mannich base or diazocarboxylate-derived group, y is an integer determined by the identity of G and equals 1 when G is absent or when present and selected from the group consisting of oxygen, sulfur and diazocarboxylate-derived linking groups, and equals 1 or 2 when G is a phenol or aniline linking group, and equals 2 when G is a nitrogen linking group, and when y equals 1 R is a substituted or unsubstituted hydrocarbyl group and when y equals 2 at most one R may be hydrogen while the remainder are hydrocarbyl groups, and the R group may be the same or different, and wherein when x is greater than 1 the $GR_y$ may be the same or different and at most one R may be hydrogen. Preferred are substituted fullerenes that are alkylamino-substituted fullerenes. The compositions are useful as flow-improvers properties.

10 Claims, No Drawings

SUBSTITUTED FULLERENES AS FLOW IMPROVERS

FIELD OF THE INVENTION

The invention relates to additive compositions and the use of the additives to improve the flow properties of natural and synthetic hydrocarbonaceous fuel and oil compounds, including crude oil, heavy fuel oil, fuel oil, distillate fuel, kerosene, lubricating oil, and also in the dewaxing process to make lubricating oils.

BACKGROUND OF THE INVENTION

Large, straight and branched chain alkanes (waxes) have a tendency to separate from fuels and oils due to their tendency to crystallize at low temperatures and on standing. This is undesirable because separation impairs the desirable properties of the base oil or fuel oil, particularly its ability to flow. Additives may be used to minimize or inhibit the undesirable effects associated with wax crystallization as well as to impart desirable properties to base oils or fuels or to enhance existing beneficial properties. In order to accomplish this they must interact with the waxy components of the oil. Thus, the structural properties of flow improvers require the presence of a portion of the molecule which resembles that of the wax, i.e., a sequence of consecutive $CH_2$ units that are sufficient to impart wax-like properties to the unit or molecule. In addition, the presence of some feature or features which do not resemble the wax is required. This allows the flow improver to interact with the growing wax crystal and bind to its surface, but to interrupt further growth of the wax crystal. For example, additives can alter the crystalline properties of waxes, typically by either suppressing crystallization or by modifying the growth of crystals so that they are small enough not to impede flow of the base oil or fuel oil through filters or pipes. Such additives are known as wax crystal modifiers and also as cold flow improvers because they improve flow properties at low temperatures. Often a range of additives is needed in order to provide an oil with optimum properties. Thus novel additives and additive formulations are constantly in demand.

SUMMARY OF THE INVENTION

The present invention provides for oil compositions, comprising a synthetic or naturally occurring hydrocarbonaceous compound, including crude oils, heavy fuel oil, fuel oil, distillate fuel, kerosene, lubricating oil and plant-derived oils selected from the group consisting of base oils and fuel oils and a pour point depressing amount of a pour point depressing substituted fullerene effective to improve the flow properties of the compound, the process of making them and the products produced by the processes disclosed herein. Typically, the hydrocarbonaceous compounds also may be referred to as base oils (base stocks) and fuel oils (fuels).

In one embodiment, the substituted fullerenes may be represented by the formula:

$$C_{Fn}(GR_y)_x$$

wherein $C_{Fn}$ is a fullerene molecule or mixture of fullerene molecules, wherein n designates the number of carbon atoms in the fullerene, wherein x is an integer from 1 up to the maximum number of sites on the fullerene molecule available for adding substituent groups, preferably 2 to 20, more preferably 6 to 14, wherein G is a linking group between the fullerene and R which may be absent, and thus the formula would be $C_{Fn}(R)_x$, or when present is selected from the group consisting of oxygen (ether or ester linking groups), sulfur (sulfide linking groups), nitrogen (amine linking groups), phenol (whether linked through carbon or oxygen), aniline (whether linked through carbon or nitrogen), Mannich base and CHC(O)O (diazocarboxylate-derived) linking groups. Also in the formula y is a number determined by the nature or identity of the linking group, G, and equals 1 when G is absent, and when G is present and is selected from the group consisting of oxygen, sulfur, and diazocarboxylate-derived linking groups, and y equals 1 or 2 when G is selected from the group consisting of phenol and aniline linking groups, and y equals 2 when G is a nitrogen linking group, and wherein when y equals 1 R is a hydrocarbyl group and when y equals 2, the R groups may be the same or different and at most one R group of each GRy may be H, and wherein the GRy may be the same or different from each other.

A particularly useful embodiment of the present invention comprises aminosubstituted fullerenes. In an aminosubstituted fullerene, $GR_y$ equals $NR_2$, wherein one R is a hydrocarbyl group and the other R may be a hydrogen or a hydrocarbyl group, wherein the two R groups may be the same or different and wherein when more than one $NR_2$ group is present, the $NR_2$ may be the same or different from each other.

In the substituted fullerene additives, the substituted fullerenes should contain at least one long-chain alkyl or substantially long-chain alkyl group of sufficient number of carbon atoms (length and degree of branching) to result in a flow improving additive. The connection of the substituent fullerene may be produced either by addition of the long-chain alkyl or substituted long-chain alkyl group directly to a fullerene or by reaction of a suitable precursor with a fullerene which has been chemically modified to allow such a connection. Some examples of the latter group of substituted fullerenes include, but are not limited to, alkylated derivatives of fullerene-aniline and fullerene-phenol adducts, and alkyl esters of fullerene diazoester addition products.

In addition to the groups $GR_y(NR_2$ in the case of aminofullerenes), other groups may be added to the fullerenes to the extent that they do not detract from the flow improving properties of the substituted fullerene. These other groups include, but are not limited to: hydrogen, hydroxyl (OH), halide and carboxylic acid (COOH). These groups may be introduced as consequences of the methods of synthesis used to introduce the $GR_y(NR_2)$ groups, or deliberately added to produce small changes in properties, such as solubility in oil, to improve the overall flow-improving performance of the substituted fullerenes.

The compositions may be used in effective amounts, typically a major amount of base oil or fuel and a minor, flow improving amount of a flow improving substituted fullerene composition, as flow improvers in hydrocarbonaceous compounds typically used as oil base stocks and fuel oils. As used herein flow improvers include pour point improvers, such as pour point depressants for the base oils.

When used herein, the term "hydrocarbyl group" or "hydrocarbyl" includes both unsubstituted hydrocarbyl groups and substituted hydrocarbyl groups.

The present invention also provides for novel additive concentrates and oils and fuels treated with the additives containing the foregoing substituted, and especially aminosubstituted fullerenes.

The present invention may suitably comprise, consist, or consist essentially of the elements disclosed herein and includes the products produced by the processes disclosed herein.

DETAILED DESCRIPTION OF THE INVENTION

The present invention provides for certain novel additive and formulated additive compositions, containing in combination certain flow improving substituted fullerenes, especially aminosubstituted fullerenes, and a natural or synthetic hydrocarbonaceous compounds such as crude oil, heavy fuel oil, fuel oil, distillate fuel, kerosene, or lubricating oil. The hydrocarbonaceous compounds may be derived from mineral oils, animal or vegetable sources or any mixture thereof. Examples of these latter cases include rapeseed oil and its alkyl esters.

The base or starting oil or fuel to which the substituted fullerene is added or used in combination with may be either a natural or synthetic oil. For example, the oil may be a crude oil, i.e. an oil as obtained from drilling and before refining, when the oil composition may be used as a cold flow improver. The base oil also may be any oil such as a lubricating oil which may be an animal, vegetable or mineral oil, for example petroleum oil fractions ranging from naphthas or spindle oil to lubricating oil grades, castor oil, fish oils or oxidized mineral oil. The additive composition may be used as a cold flow improver, cloud point depressant, pour point depressant or dewaxing aid in lubricating oils and fuels. Examples of fuel oils are middle distillate fuel oils, i.e. fuels obtained in refining crude oil as the fraction between the lighter kerosene and jet fuels fraction and the heavy gas oil fraction. Examples are diesel fuel, aviation fuel, kerosene, fuel oil, jet fuel and heating oil, etc. Generally, suitable distillate fuels are those boiling in the range of 120° to 500° C., preferably those boiling in the range 150° to 400° C. The fuel oil may be an animal, vegetable or mineral oil. The oil may also contain other additives such as stabilizers, dispersants, antioxidants, corrosion inhibitors and/or demulsifiers as well as other wax crystal modifying additives. Heating oils may be made of a blend of virgin distillate, e.g. gas oil, naphtha, etc. and cracked distillates, e.g. catalytic cycle stock. A representative specification for a diesel fuel includes a minimum flash point of 38° C. and 90% distillation range between 282° and 338° C. (see ASTM Designations D-396 and D-975).

The substituted fullerenes may be produced as reaction products of fullerenes with hydrocarbon molecules that are long-chain alkyl or substantially long-chain alkyl in nature. These molecules may contain other functionalities, specifically a linking group as further described herein as needed to effect reaction with the fullerene. In some cases in order to synthesize the substituted fullerene the fullerene first may be converted to an intermediate derivative in order to facilitate reaction with the long-chain alkyl or substantially long-chain alkyl molecule.

The present invention also provides for the use of these adducts in effective amounts to present improve the flow properties and pour points of the oils.

In one embodiment, the substituted fullerenes may be represented generally by the formula:

$$C_{Fn}(GR_y)_x$$

wherein $CF_n$ is a fullerene molecule or mixture of fullerene molecules, wherein n corresponds to the number of carbon atoms in the fullerene, wherein x is an integer from 1 up to the maximum number of sites on the fullerene molecule available for bonding substituent groups, preferably from 2 to 20, more preferably from 6 to 14, wherein G is a linking group between the fullerene and R which may be absent or present, and when present is selected from the group consisting of oxygen (ether or ester) sulfur (sulfide), nitrogen (amine), phenol (whether linked through carbon or oxygen), aniline (whether linked through carbon or nitrogen), Mannich base and CHC(O)O (diazocarboxylate-derived) linking groups, wherein y is a number determined by the nature or identity of the linking group, and equals 1 when G is absent or when G is present and selected from the group consisting of oxygen, sulfur and diazocarboxylate-derived linking groups, and y equals 1 or 2 when G is selected from the group consisting of phenol and aniline linking groups, and y equals 2 when G is a nitrogen linking group, and wherein when y equals 1, R is a hydrocarbyl group and when y equals 2, one R group may be a hydrocarbyl group or H and the remaining R group is a hydrocarbyl group and the R groups may be the same or different, and wherein when x is greater than 1 the $GR_y$ groups may be the same or different from each other. When G is absent, and thus no linking group is present, the formula may be represented more simply as $C_{fn}R_x$, with the symbols in the formula as specified previously. When x is an integer less than the maximum number of sites on the fullerene molecule available for bonding the substituent groups, the sites not containing the $GR_y$ groups ($NR_2$ in the case of aminofullerenes) may contain other substituent groups that do not detract from or interfere with the flow improving properties of the substituted fullerene. These other groups include, but are not limited to hydrogen, hydroxyl (OH), halide and carboxylic acid (COOH). These groups may be introduced as consequences of the methods of synthesis used to introduce the $GR_y$ ($NR_2$) groups, or deliberately added to produce small changes in properties, such as solubility in oil, to improve the overall flow-improving performance of the substituted fullerenes. In a particular embodiment, aminosubstituted fullerenes may be represented by the formula $C_F(NR_2)_x$, wherein $GR_y$ equals $NR_2$, wherein R is a hydrocarbyl group, wherein the two R groups may be the same or different and at most one R may be hydrogen, and wherein when more than one $NR_2$ is present, the $NR_2$ may be the same or different from each other.

The hydrocarbyl groups are preferably long chain, wax-like alkyl, alkenyl, aromatic and heteroaromatic hydrocarbyl groups, and may be substituted hydrocarbyl groups. If one or more of the hydrocarbyl groups is substituted, the substituents should be substantially inert or non-interfering to the composition and in the combination in which it is used. Linear or substantially linear alkyl groups are more preferred. When the alkyl groups are substituted, typical heteroatoms such as O and S may be included. Suitable hydrocarbyl groups are those containing in the range of from about 8 to about 30, more preferably 8 to 24, most preferably 10 to 22 carbon atoms for the sum of the carbon atoms in each chain or R group. However, the length of each chain may be adjusted to be the same or different from the others. It is desirable when y equals 2 that the R groups together contain up to about 50 to 60 carbons atoms. Mixtures of various substituted fullerenes may also be used and, in fact, may be desirable, in order to obtain the range of properties e.g., solubility properties, desired in the oil or fuel. By way of example $C_{Fn}(GR_y)_x$ may be $C_{60}(OC_{16}H_{33})_{12}$, $C_{70}(N(C_{18}H_{37})_2)_{10}$, or $C_{60}(HNC_{16}H_{33})_3(HNC_{20}H_{41})_9$. When the substituted fullerenes are made from a starting material that is a mixture of fullerenes, the substituted fullerenes will also be a mixture.

In the formula the fullerene, $C_{Fn}$, is suitably any fullerene or mixture of fullerenes, such as $C_{60}$, $C_{70}$, $C_{84}$, $C_{96}$, $C_{120}$. It should be noted that "F" in the formula "$C_{Fn}$" designates the molecule as a fullerene and "n" corresponds to the numerical subscript designating the number of carbon atoms in the fullerene, i.e., 60, 70, 84 and the like. A commonly used mixture of fullerenes is that obtained by extraction of soots produced in the arc process for fullerene production. It typically consists of 70% to 90% $C_{60}$, 9% to 29% $C_{70}$ and less than 1% fullerenes of higher carbon number. Such a material is called a fullerene extract herein. The maximum number of sites available for adding or attaching the substituent group or groups to the fullerene will vary depending on the fullerene but the actual number of substituents added should be chosen within the disclosed ranges to produce an improvement in the cold flow properties of the base oil or fuel oil, and can readily be determined by one skilled in the art by applying the teachings disclosed herein.

The nature of the base oil will influence the choice of substituted fullerene additive, particularly with respect to the size and of number (i.e., the value of x in the formula) of the hydrocarbyl groups to be added. However, these should generally be effective to render the substituted fullerene a suitable flow-improving additive for the particular oil. Generally, this requires it to be compatible with or soluble in the oil or fuel.

Pour point depression may be achieved by tailoring the additive to the waxy components of the oil. This can be achieved by varying the value of x, i.e., adding more substituent hydrocarbyl functionalities, and optionally linking groups (designated as G in the formula) to the fullerene, inclusion of polar functionalities and varying the length of the linear alkyl portion of the group or functionality. Since base stocks and fuels vary, mixtures of several substituted fullerene additives wherein either the substituents are different or wherein mixtures of fullerenes are present, or both may be more desirable. Thus mixtures having differing number values of x or different values of "n" in the formulas are preferred.

The range of molecular weights of the resulting substituted fullerenes should be effective to render the substituted fullerene compatible with the oil and suitable for use as a flow improving additive for those oils and fuel oils. Typically, the molecular weight of the substituted fullerene adduct may be from about 1,000 to about 20,000 depending on the oil, as measured by gel permeation chromatography or mass spectrometry methods.

The substituted fullerene adducts may generally be prepared by combining the fullerene and an effective amount of the starting material in a suitable solvent such as toluene for a sufficient time to form the adduct having the properties and general formulas described above.

The various substituted fullerenes can be made by methods known in the literature. Aminosubstituted fullerene adducts may generally be prepared by combining the fullerene and an effective amount of a primary or secondary amine in a suitable solvent, such as toluene, or with no solvent, for a sufficient time to form an adduct having the properties and general formulas described above. Methods for forming aminosubstituted fullerenes are described by Wudl, et al. in A. C. S. Symposium Series vol. 481, pages 161–175, 1991. Alkylsubstituted fullerene adducts can be made by reduction and alkylation, as described by Bausch et al. J. Am. Chem. Soc. vol. 113, pages 3205–3206, 1991. Alkoxysubstituted fullerenes can be prepared by direct addition of alcohols to fullerenes as taught by Miller, et al. European Patent Application 0,546,718, Jun. 16, 1993. In addition, fullerenes can be converted to fullerols as taught by Chiang et al. U.S. Pat. No. 5,177,248 or by Li et al. J. Chem. Soc., Chem. Commun. pages 1784–1785, 1993. Those, in combination with long-chain alkyl halides, can be converted to ethers by the well known Williamson synthesis, as described in March, "Advanced Organic Chemistry", 4th edition, John Wiley & Sons, New York, 1992. Alkylcarboxysubstituted fullerenes can be prepared by the esterification of fullerols described above, as described in March, pages 392–398. Thioalkylsubstituted fullerenes can be made by direct addition of mercaptans to fullerenes as taught by Miller cited above. Addition of aromatic compounds to fullerenes can be accomplished by the methods of Olah et al. J. Am. Chem. Soc. vol. 113, pages 9384–9387 and 9387–9388, 1991, Taylor et al. J. Chem. Soc., Chem. Commun. pages 667– 668 or Miller above. Use of phenol or aniline substituted with long chain alkyl groups or their protected derivatives can give arylated fullerenes. Addition of phenol or aniline or their protected derivatives can be followed by alkylation of the aromatic rings with long-chain alkyl groups in standard ways. A third embodiment comprises reaction of phenol-substituted fullerenes with formaldehyde and long-chain alkylamines to give Mannich reaction products (see March, pages 900–902). Addition of diazoesters to fullerenes gives adducts which are commonly referred to as fulleroids (see Suzuki et al. Science vol. 254, pages 1186–1188, 1991). Use of appropriate long-chain alkyl esters of diazoacetic acid will give compounds useful as flow improvers. In another embodiment, addition of other types of diazoesters can give fulleroids which can be transesterified with long-chain alcohols to give long-chain alkylfulleroids. Transesterification of esters is a well known process as described by March (cited above, pages 397–398). The application of transesterification to fulleroids has been described by Isaacs, et al. Helv. Chim. Acta vol. 76, pages 2454–2464, 1993.

The other starting materials for preparation of the substituted fullerenes used in the present invention also can be obtained from commercial sources or produced using known procedures.

The formulated oil and fuel compositions of the present invention comprise an oil or fuel as defined above and a cold flow improving amount of a substituted, and especially aminosubstituted fullerene, as an additive in combination therewith, particularly to improve the pour point of the composition. Such an improvement is generally measured by comparison to the base oil or fuel without the substituted fullerene additive and in combination with such oils. Typically such improvement may be measured by depression of the pour point, according to known techniques, such as the methods described in ASTM D97. The effective amount of substituted fullerene additive suitably may be a minor amount by weight in comparison to a major amount by weight of the base oil, or fuel preferably from about 0.001 to about 10 wt %, more preferably about 0.005% to about 1 wt. %, most preferably from about 0.01 to about 0.5 wt %.

Another embodiment of the invention is additive concentrates, wherein the substituted fullerene, especially aminosubstituted fullerene, additive may form from about 0.01 to about 80 wt % of the total concentrate. Examples of liquid carriers for use in such concentrates are solvents such as aromatic naphthas and mineral lubricating oils.

Other additives also may be present in a final lubricating oil, examples being viscosity index improvers such as ethylene-propylene copolymers, dispersants (e.g., succinic acid-based), and metal containing dispersant additives and antiwear additives (e.g., zinc dialkyl-dithiophosphates). However, combination of the substituted fullerene additives with co-additives with which they might undergo incompatible interactions or reactions should be minimized.

The oil compositions and additive concentrates of the present invention may be used in combination with other co-additives, e.g. other cold flow improvers, as known in the art, such as ethylene vinyl acetate copolymers and fumarate vinyl acetate copolymers. When multicomponent additive systems are used, the ratios of additives to be used will be determined by the properties of the oil to be treated.

It is appropriate to use combinations of additives where necessary to achieve maximum performance benefits. The additives which are the subject of this invention may be used alone, in mixtures comprising more than one component which is the subject of this invention, and in combination with any other additive which are known to be effective in these systems. Such combinations may be in the form of additive concentrates (where the additives are present usually from about 1% to 80%) or in their final form in the oil where the usual concentration is from about 0.001% to 10%. Examples of additives that may form part of these mixtures are given below:

(i) a comb polymer such as a copolymer of vinyl acetate and long-chain dialkyl fumarates, as described in PCT/International Publication No. W.O. 93/08243.

(ii) a polyoxyalkylene ester, ether, ester/ether or a mixture thereof, as described, for example in U.S. Pat. No. 4,491,455.

(iii) an ethylene/unsaturated ester copolymer, typically for example as described in U.S. Pat. No. 3,961,916, and typically having a polymethylene backbone divided into segments by oxyhydrocarbon side chains.

(iv) a polar organic, nitrogen-containing wax crystal growth inhibitor, such as amine salt and/or amide reaction products of at least one molar proportion of a hydrocarbyl substituted amine with one molar proportion of a hydrocarbyl acid having 1 to 4 acid groups, or their anhydrides or acid chlorides, or ester/amides for example as described in U.S. Pat. No. 4,211,534 or EP-A-O, 261,957.

(v) a hydrocarbon polymer, typically which is a copolymer of ethylene and an alpha olefin with Mn≧30,000.

(vi) a hydrocarbylated-aromatic pour point depressant that is a condensate comprising aromatic and hydrocarbyl parts, such as a condensation product of naphthalene and a chlorinated wax.

The invention may be demonstrated with reference to the following non-limiting examples.

EXAMPLES

Unless indicated otherwise in the particular example the fullerene extract contained a mixture of fullerenes in the amount of approximately 75% $C_{60}$, 25% $C_{70}$, and less than 1% higher fullerenes.

Example 1 Preparation of Hexadecylaminofullerenes 0.2 grams of fullerene extract and 0.81 grams of hexadecylamine (Armeen 16D from Akzo) were dissolved in 50 ml toluene. The dark colored solution was stirred for 6 days at 40° C. The solvent was removed under vacuum and the product was dissolved in chloroform and filtered to remove unreacted fullerene.

Example 2 Preparation of 150N Oil-Substituted Fullerene Additive Composition One part by weight of the product as in Example 1 and 999 parts by weight of solvent 150 neutral base oil ("150N") were mixed at 65° C. for one hour and allowed to cool. The product formed a homogeneous solution. Solvent 150 neutral base oil is a solvent refined hydrocarbon oil. Typical properties of the solvent 150 neutral base oil and the ASTM standards according to which they are measured include flash point, 204° C. (ASTM D092); API gravity, 29.5–31.5 (ASTM D287); pour point, −12° C. (ASTM D97); kinematic viscosity at 40° C., 29.0–31.0 (ASTM D445); and viscosity index, 95 (ASTM D2270).

Example 3 Preparation of 600N Oil-Substituted Fullerene Additive Composition The procedure of Example 2 was repeated using a 600N base oil having the following characteristics: flash point, 246° C. (ASTM 092); API gravity 27.5–29.5 (ASTM D287); pour point −9° C. (ASTM D97); kinematic viscosity at 40° C. 109.5–116.5 (ASTM D446); and Viscosity Index, 95 (ASTM D2270).

Example 4 Preparation of Diesel Fuel-Substituted Fullerene Additive Composition One part by weight of the product as in Example 1 and 149 parts by weight of a diesel fuel having the following characteristics: distillation curve initial boiling at 184° C., 20% at 240° C., 50% at 274° C., 80% at 314° C., 90% at 333° C., final at 360° C. and having a cloud point of −9° C., were mixed at room temperature for 1 hour. The product formed a homogeneous solution.

Example 5 Preparation of Octadecylfullerenes 100 mg $C_{60}$ was added to excess potassium metal in refluxing tetrahydrofuran to generate an insoluble fulleride salt. After cooling to 50° C., 0.5 ml octadecyl iodide (10.4 molar equivalents, based on fullerene) was added, and the whole was refluxed for one hour. The reaction was quenched by addition of water. The salts were separated, and the product was isolated by evaporation of the solvent and washing with aqueous methanol. The product was purified by precipitation from tetrahydrofuran solution with methanol and drying at 65° C. under reduced pressure.

Example 6 Pour Point Depression

Pour point depression measurements were carried out by the procedure described in ASTM D97. After preliminary heating the sample was cooled at a specified rate according to ASTM D97 and examined at intervals of 3° C. for flow characteristics. The lowest temperature at which movement of the oil was observed was recorded as the pour point. Table 1 illustrates the pour point data in °C. for the specified base stocks specifically a light oil (150N), heavy oil (600N) and diesel fuel containing the specified ppm by weight of the substituent fullerene additive. Pour point depression is calculated as the difference between the pour point of the base oil and of the oil containing the substituted fullerene additive (i.e., the "oil composition" or "oil additive composition"). It should be noted that with the subject oil compositions a maximum pour point depression was seen to occur when the hexadecylamino fullerenes (n=16) were used.

TABLE 1*

| | Substituted Fullerene $C_{Fn}(GRy)_x$ | | | | |
|---|---|---|---|---|---|
| G | R y | x | Oil | Treat Rate | Depression (°C.) |
| N (amino) | H, n-$C_{12}H_{25}$ | 2–20 | S150N | 1000 ppm | 0 |
| | H, n-$C_{12}H_{25}$ | 2–20 | S600N | 1000 ppm | −6 |
| | H, n-$C_{14}H_{29}$ | 2–20 | S150N | 1000 ppm | −9 |
| | H, n-$C_{16}H_{33}$ | 2–20 | S150N | 1000 ppm | −12 |
| | H, n-$C_{16}H_{33}$ | 2–20 | S600N | 1000 ppm | −9 |
| | H, n-$C_{16}H_{33}$ | 2–20 | Diesel | 150 ppm | −9 |
| | H, n-$C_{18}H_{35}$ | 2–20 | S150N | 1000 ppm | −3 |
| | | | S600N | 1000 ppm | −6 |
| | H, n-$C_{22}H_{45}$ | 2–20 | S150N | 1000 ppm | 0 |
| | | | S600N | 1000 ppm | 0 |
| none (alkyl) | n-$C_{18}H_{35}$ | 2–20 | S150N | 1000 ppm | −12 |

*In all cases commercial fullerene extract was used to prepare the derivatives. Thus, the fullerenes are mixtures of approximately 75% $C_{60}$, 25% $C_{70}$ and less than 1% of fullerenes with containing more than 70 carbons. These correspond to n = 60, n = 70 and n > 70 in the formula. By the method of their preparation, the substituted fullerenes are mixtures of compounds with differing numbers of substituents (differing x in the formula). The ranges shown comprise the bulk of the substituted fullerenes as tested.

What is claimed is:

1. A formulated oil composition, comprising a base oil and a flow improving amount of a substituted fullerene or mixture of substituted fullerenes represented by the formula:

$$C_{Fn}(GR_y)_x$$

wherein $C_{Fn}$ is a fullerene or mixture of fullerenes, n is the number of carbons in the fullerene, wherein G is a linking group between the fullerene and R which G may be absent or when present is selected from the group consisting of oxygen, sulfur, nitrogen, phenol, aniline, Mannich base and diazocarboxylate-derived groups, wherein R is a hydrocarbyl group, y is a positive integer determined by the identity of G, and y equals 1 when G is absent or when G is present and selected from the group consisting of oxygen, sulfur, and diazocarboxylate-derived linking groups, and y equals 1 or 2 when G is selected from the group consisting of phenol and aniline linking groups, and y equals 2 when G is a nitrogen linking group, and wherein when y equals 1 R is a hydrocarbyl group and when y equals 2, one R group is selected from a hydrocarbyl group and H and the remaining R is a hydrocarbyl group, and the R groups may be the same or different, wherein x is an integer from 1 up to the maximum number of sites on the fullerene available for adding substituent groups, and wherein when x is greater than 1 the GRy may be the same or different from each other.

2. The composition of claim 1 wherein R contains from 1 to about 30 carbon atoms.

3. The composition of claim 1 wherein when y equals 2, the two R groups together contain from about 8 to about 50 carbon atoms.

4. The composition of claim 1 wherein the base oil is selected from the group consisting of crude oil, fuel oil, and lubricating oil.

5. The composition of claim 1 wherein the substituted fullerene is present in a minor proportion by weight to the weight of the base oil.

6. The composition of claim 1 wherein the effective amount is from about 0.001 to about 10 wt. %.

7. The composition of claim 1 wherein the substituted fullerene is an alkylamino fullerene represented by the formula $C_{Fn}$ $(NR_2)_x$ wherein $C_F$ is a fullerene molecule, wherein x is an integer from 1 up to the maximum number of sites on the fullerene molecule available for substituent groups, wherein the R groups may be the same or different and wherein one R group is selected from a hydrocarbyl group and H and the remaining R group is a hydrocarbyl group, and wherein when x is greater than 1 the $NR_2$ may be the same or different.

8. An additive concentrate, comprising a mixture of a flow improving amount of a substituted fullerene in a liquid medium compatible with a base oil.

9. A method of improving the flow properties of a base oil or fuel, comprising adding a pour point depressing amount of a pour point depressing substituted fullerene to the base oil.

10. A flow improving amount of a substituted fullerene in combination with at least one base oil.

* * * * *